US008155965B2

(12) United States Patent
Kapoor et al.

(10) Patent No.: US 8,155,965 B2
(45) Date of Patent: Apr. 10, 2012

(54) TIME WARPING FRAMES INSIDE THE VOCODER BY MODIFYING THE RESIDUAL

(75) Inventors: Rohit Kapoor, San Diego, CA (US); Serafin Diaz Spindola, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 910 days.

(21) Appl. No.: 11/123,467

(22) Filed: May 5, 2005

(65) Prior Publication Data

US 2006/0206334 A1 Sep. 14, 2006

Related U.S. Application Data

(60) Provisional application No. 60/660,824, filed on Mar. 11, 2005.

(51) Int. Cl.
*G10L 13/06* (2006.01)

(52) U.S. Cl. ..... 704/267; 370/352; 370/516; 700/94; 704/94; 704/200.1; 704/211; 704/223; 704/226; 704/258; 714/776

(58) Field of Classification Search ..... 704/258, 704/226, 200.1, 211, 223; 370/352, 516; 700/94; 714/776
See application file for complete search history.

(56) References Cited

U.S. PATENT DOCUMENTS 4,710,960 A 12/1987 Sato
5,283,811 A 2/1994 Chennakeshu et al.
5,317,604 A 5/1994 Osterweil
5,371,853 A * 12/1994 Kao et al. ..... 704/200.1
5,440,562 A 8/1995 Cutler
5,490,479 A 2/1996 Shalev
5,586,193 A 12/1996 Ichise et al.
(Continued)

FOREIGN PATENT DOCUMENTS

CN ZL018103383 10/2005
(Continued)

OTHER PUBLICATIONS

Liang et al. "Adaptive playout scheduling using time-scale modification in packet voice communications," *Acoustics, Speech, and Signal Processing, 2001. Proceedings. (ICASSP '01), 2001 IEEE International Conference*, vol. 3, May 7-11, 2001, pp. 1445-1448.
(Continued)

*Primary Examiner* — Michael Colucci
(74) *Attorney, Agent, or Firm* — Larry J. Moskowitz; Heejong Yoo

(57) ABSTRACT

In one embodiment, the present invention comprises a vocoder having at least one input and at least one output, an encoder comprising a filter having at least one input operably connected to the input of the vocoder and at least one output, a decoder comprising a synthesizer having at least one input operably connected to the at least one output of the encoder, and at least one output operably connected to the at least one output of the vocoder, wherein the encoder comprises a memory and the encoder is adapted to execute instructions stored in the memory comprising classifying speech segments and encoding speech segments, and the decoder comprises a memory and the decoder is adapted to execute instructions stored in the memory comprising time-warping a residual speech signal to an expanded or compressed version of the residual speech signal.

35 Claims, 9 Drawing Sheets

U.S. PATENT DOCUMENTS

| | | | | |
|---|---|---|---|---|
| 5,640,388 | A | 6/1997 | Woodhead et al. | |
| 5,696,557 | A | 12/1997 | Yamashita et al. | |
| 5,794,186 | A | 8/1998 | Bergstrom et al. | |
| 5,899,966 | A | 5/1999 | Matsumoto et al. | |
| 5,929,921 | A | 7/1999 | Taniguchi et al. | |
| 5,940,479 | A | 8/1999 | Guy et al. | |
| 5,966,187 | A | 10/1999 | Do | |
| 6,073,092 | A | 6/2000 | Kwon | |
| 6,134,200 | A | 10/2000 | Timmermans | |
| 6,240,386 | B1 | 5/2001 | Thyssen | |
| 6,259,677 | B1 | 7/2001 | Jain | |
| 6,366,880 | B1 * | 4/2002 | Ashley | 704/226 |
| 6,370,125 | B1 | 4/2002 | Belk | |
| 6,377,931 | B1 | 4/2002 | Shlomot | |
| 6,456,964 | B2 | 9/2002 | Manjunath et al. | |
| 6,496,794 | B1 | 12/2002 | Kleider et al. | |
| 6,693,921 | B1 | 2/2004 | Whitfield | |
| 6,785,230 | B1 | 8/2004 | Ogata et al. | |
| 6,813,274 | B1 | 11/2004 | Suzuki et al. | |
| 6,859,460 | B1 | 2/2005 | Chen | |
| 6,922,669 | B2 | 7/2005 | Schalk et al. | |
| 6,925,340 | B1 | 8/2005 | Suito et al. | |
| 6,944,510 | B1 * | 9/2005 | Ballesty et al. | 700/94 |
| 6,996,626 | B1 | 2/2006 | Smith | |
| 7,006,511 | B2 | 2/2006 | Lanzafame et al. | |
| 7,016,970 | B2 | 3/2006 | Harumoto et al. | |
| 7,079,486 | B2 | 7/2006 | Colavito et al. | |
| 7,117,156 | B1 | 10/2006 | Kapilow | |
| 7,126,957 | B1 | 10/2006 | Isukaoalli et al. | |
| 7,158,572 | B2 | 1/2007 | Dunne et al. | |
| 7,263,109 | B2 | 8/2007 | Ternovsky | |
| 7,266,127 | B2 | 9/2007 | Gupta et al. | |
| 7,272,400 | B1 | 9/2007 | Othmer | |
| 7,280,510 | B2 | 10/2007 | Lothia et al. | |
| 7,336,678 | B2 | 2/2008 | Vinnakota et al. | |
| 7,424,026 | B2 | 9/2008 | Mallila | |
| 7,496,086 | B2 | 2/2009 | Eckberg | |
| 7,525,918 | B2 | 4/2009 | LeBlanc et al. | |
| 7,551,671 | B2 | 6/2009 | Tyldesley et al. | |
| 2002/0016711 | A1 * | 2/2002 | Manjunath et al. | 704/258 |
| 2002/0133334 | A1 * | 9/2002 | Coorman et al. | 704/211 |
| 2002/0133534 | A1 | 9/2002 | Forslow | |
| 2002/0145999 | A1 | 10/2002 | Dzik | |
| 2003/0152093 | A1 | 8/2003 | Gupta et al. | |
| 2003/0152094 | A1 | 8/2003 | Colavito et al. | |
| 2003/0152152 | A1 | 8/2003 | Dunne et al. | |
| 2003/0185186 | A1 | 10/2003 | Tsutsumi et al. | |
| 2003/0202528 | A1 | 10/2003 | Eckberg | |
| 2004/0022262 | A1 | 2/2004 | Vinnakota et al. | |
| 2004/0039464 | A1 | 2/2004 | Virolainen et al. | |
| 2004/0057445 | A1 | 3/2004 | LeBlanc | |
| 2004/0120309 | A1 * | 6/2004 | Kurittu et al. | 370/352 |
| 2004/0141528 | A1 | 7/2004 | LeBlanc et al. | |
| 2004/0156397 | A1 * | 8/2004 | Heikkinen et al. | 370/516 |
| 2004/0179474 | A1 | 9/2004 | Usuda et al. | |
| 2004/0204935 | A1 | 10/2004 | Anandakumar et al. | |
| 2005/0007952 | A1 | 1/2005 | Scott | |
| 2005/0036459 | A1 | 2/2005 | Kexys et al. | |
| 2005/0058145 | A1 | 3/2005 | Florencio et al. | |
| 2005/0089003 | A1 | 4/2005 | Proctor et al. | |
| 2005/0180405 | A1 | 8/2005 | Bastin | |
| 2005/0228648 | A1 | 10/2005 | Heikkinen et al. | |
| 2005/0243846 | A1 | 11/2005 | Mallila | |
| 2006/0077994 | A1 | 4/2006 | Spindola et al. | |
| 2006/0171419 | A1 | 8/2006 | Spindola et al. | |
| 2006/0184861 | A1 * | 8/2006 | Sun et al. | 714/776 |
| 2006/0187970 | A1 | 8/2006 | Lee et al. | |
| 2006/0277042 | A1 * | 12/2006 | Vos et al. | 704/223 |
| 2007/0206645 | A1 | 9/2007 | Sundqvist et al. | |

FOREIGN PATENT DOCUMENTS

| | | | |
|---|---|---|---|
| EP | 0707398 | | 4/1996 |
| EP | 0731448 | A2 | 9/1996 |
| EP | 1088303 | A1 | 4/2001 |
| EP | 1221694 | | 7/2002 |
| EP | 1278353 | | 12/2003 |
| EP | 1536582 | | 6/2005 |
| JP | 56-43800 | | 10/1981 |
| JP | 57158247 | A | 9/1982 |
| JP | 61-156949 | | 7/1986 |
| JP | 64029141 | | 1/1989 |
| JP | 02081538 | | 3/1990 |
| JP | 2502776 | | 8/1990 |
| JP | 04-113744 | | 4/1992 |
| JP | 04150241 | | 5/1992 |
| JP | 8130544 | A | 5/1996 |
| JP | 08256131 | | 10/1996 |
| JP | 9127995 | A | 5/1997 |
| JP | 09261613 | | 10/1997 |
| JP | 10-190735 | | 7/1998 |
| JP | 2001045067 | | 2/2001 |
| JP | 2001134300 | A | 5/2001 |
| JP | 2003532149 | | 10/2003 |
| JP | 2004153618 | A | 5/2004 |
| JP | 2004-266724 | | 9/2004 |
| JP | 2004-282692 | | 10/2004 |
| JP | 2005-057504 | | 3/2005 |
| JP | 2005521907 | T | 7/2005 |
| JP | 2006-050488 | | 2/2006 |
| KR | 20040050813 | | 6/2004 |
| RU | 2073913 | | 2/1997 |
| RU | 2118058 | | 8/1998 |
| WO | 8807297 | | 9/1988 |
| WO | 9222891 | | 12/1992 |
| WO | 9522819 | | 8/1995 |
| WO | 9710586 | | 3/1997 |
| WO | 0024144 | | 4/2000 |
| WO | 0033503 | | 6/2000 |
| WO | 0042749 | | 7/2000 |
| WO | WO0055829 | | 9/2000 |
| WO | WO0063885 | A1 | 10/2000 |
| WO | WO0176162 | A1 | 10/2001 |
| WO | WO 01/82289 | | 11/2001 |
| WO | WO0182293 | | 11/2001 |
| WO | WO03083834 | A1 | 10/2003 |
| WO | WO03090209 | A1 | 10/2003 |
| WO | 2006099534 | | 9/2006 |

OTHER PUBLICATIONS

Verhelst et al. "An overlap-add technique based on waveform similarity (WSOLA) for high quality time-scale modification of speech," Acoustics, Speech, and Signal Processing, 1993. ICASSP-93., 1993 IEEE International Conference, vol. 2, Apr. 27-30, 1993 pp. 554-557.

Verhelst, W. et al. *An Overlap-Add Technique Based on Waveform Similarity (WSOLA) for High Quality Time-Scale Modification of Speech*, New York, IEEE, US, vol. 4, Apr. 27, 1993; pp. 554-557.

International Search Report dated Jun. 27, 2006 (4 pgs.).

Benaissa et al., "An algorithm for delay adjustment for Interactive audio applications in mobile ad hoc networks," Proceedings of the Seventh International Symposium on Computers and Communications, Jul. 2002, pp. 524-529.

Choudhury, et al., "Design and Analysis of Optimal Adaptive Dejitter Buffers," Computer Communications, Elsevier Science Publishers BV, vol. 27, No. 6, Apr. 2004, pp. 529-537.

E. Moulines et al.: "Time-Domain and Frequency-Domain Techniques for Prosodic Modification of Speech," 1995 Elsevier Science B.V., (Chapter 15), pp. 519-555, XP002366713.

Internationai Search Report—PCT/US06/009472—International Search Authority, European Patent Office—Jun. 27, 2006.

Written Opinion—PCT/US06/009472—International Search Authority, European Patent Office—Jun. 27, 2006.

International Preliminary Report on Patentability—PCT/US06/009472—The International Bureau of WIPO, Geneva, Switzerland—Sep. 12, 2007.

Bellavista, Paolo; Corradi, Antonio; Giannelli, Carlo: "Adaptive Buffering-based on Handoff Prediction for Wireless Internet Continuous Services", [Online] Sep. 23, 2005, pp. 1-12, XP002609715, Retrieved from the Internet : URL: http://citeseerx. ist .psu.edu/viewdoc/summary?doi=10.1.1.62.6005>.

Vatn, Jon-Olov: "Thesis proposal: Supporting real-time services to mobile Internet hosts". [Online] Jun. 5, 2002, pp. 1-21, XP002609716, Retrieved from the Internet: URL:http://web. it. kth. se/{maguire/vatn/res earch/thesis-proposal-updated. pdf> [retrieved on Nov. 15, 2010].
"Enhanced Variable Rate Codec, Speech Service Option 3 for Wideband Spread Spectrum Digital Systems," 3GPP2 C.S0014-A (Apr. 2004).
Boku et al., "Structures and Network Performance of The Ultra-fast Optical Packet Switching Ring Network", Technical Report of IEICE, Japan, The Institute of Electronics, Information and Communication Engineers, Jul. 26, 2002, vol. 102, No. 257, CS2002-56.

* cited by examiner $$a)\ OutSegment[i] = \frac{(Segment1(i) * (WindowSize - i) + (Segment2(i) * i)}{WindowSize}$$

$$b)\ OutSegment[i] = \frac{(Segment2(i) * (WindowSize - i) + (Segment1(i) * i)}{WindowSize}$$

i=0..WindowSize-1 WindowSize=R WindowSize

FIG. 8

TIME WARPING FRAMES INSIDE THE VOCODER BY MODIFYING THE RESIDUAL

CLAIM OF PRIORITY UNDER 35 U.S.C. §119

This application claims benefit of U.S. Provisional Application No. 60/660,824 entitled "Time Warping Frames Inside the Vocoder by Modifying the Residual" filed Mar. 11, 2005, the entire disclosure of this application being considered part of the disclosure of this application and hereby incorporated by reference.

BACKGROUND

1. Field

The present invention relates generally to a method to time-warp (expand or compress) vocoder frames in the vocoder. Time-warping has a number of applications in packet-switched networks where vocoder packets may arrive asynchronously. While time-warping may be performed either inside the vocoder or outside the vocoder, doing it in the vocoder offers a number of advantages such as better quality of warped frames and reduced computational load. The methods presented in this document can be applied to any vocoder which uses similar techniques as referred to in this patent application to vocode voice data.

2. Background

The present invention comprises an apparatus and method for time-warping speech frames by manipulating the speech signal. In one embodiment, the present method and apparatus is used in, but not limited to, Fourth Generation Vocoder (4GV). The disclosed embodiments comprise methods and apparatuses to expand/compress different types of speech segments.

SUMMARY

In view of the above, the described features of the present invention generally relate to one or more improved systems, methods and/or apparatuses for communicating speech.

In one embodiment, the present invention comprises a method of communicating speech comprising the steps of classifying speech segments, encoding the speech segments using code excited linear prediction, and time-warping a residual speech signal to an expanded or compressed version of the residual speech signal.

In another embodiment, the method of communicating speech further comprises sending the speech signal through a linear predictive coding filter, whereby short-term correlations in the speech signal are filtered out, and outputting linear predictive coding coefficients and a residual signal.

In another embodiment, the encoding is code-excited linear prediction encoding and the step of time-warping comprises estimating pitch delay, dividing a speech frame into pitch periods, wherein boundaries of the pitch periods are determined using the pitch delay at various points in the speech frame, overlapping the pitch periods if the speech residual signal is compressed, and adding the pitch periods if the speech residual signal is expanded.

In another embodiment, the encoding is prototype pitch period encoding and the step of time-warping comprises estimating at least one pitch period, interpolating the at least one pitch period, adding the at least one pitch period when expanding the residual speech signal, and subtracting the at least one pitch period when compressing the residual speech signal.

In another embodiment, the encoding is noise-excited linear prediction encoding, and the step of time-warping comprises applying possibly different gains to different parts of a speech segment before synthesizing it.

In another embodiment, the present invention comprises a vocoder having at least one input and at least one output, an encoder including a filter having at least one input operably connected to the input of the vocoder and at least one output, a decoder including a synthesizer having at least one input operably connected to the at least one output of said encoder and at least one output operably connected to the at least one output of said vocoder.

In another embodiment, the encoder comprises a memory, wherein the encoder is adapted to execute instructions stored in the memory comprising classifying speech segments as ⅛ frame, prototype pitch period, code-excited linear prediction or noise-excited linear prediction.

In another embodiment, the decoder comprises a memory and the decoder is adapted to execute instructions stored in the memory comprising time-warping a residual signal to an expanded or compressed version of the residual signal.

Further scope of applicability of the present invention will become apparent from the following detailed description, claims, and drawings. However, it should be understood that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention will become more fully understood from the detailed description given here below, the appended claims, and the accompanying drawings in which:

FIG. 8 contains two equations used in the add-overlap method.

DETAILED DESCRIPTION

Figure 1:
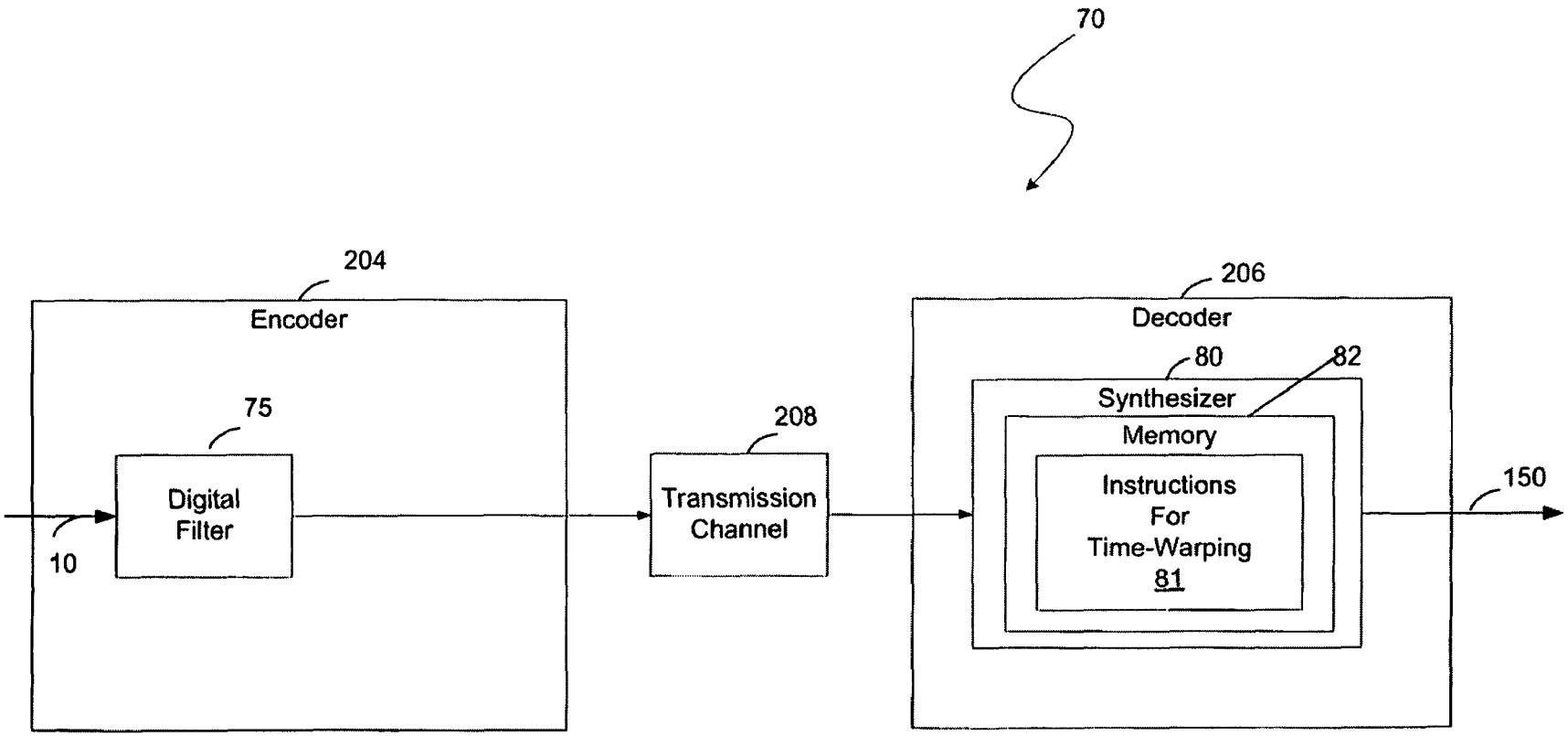
FIG. 1 is a block diagram of a Linear Predictive Coding (LPC) vocoder.

The word "illustrative" is used herein to mean "serving as an example, instance, or illustration." Any embodiment described herein as "illustrative" is not necessarily to be construed as preferred or advantageous over other embodiments.

Features of Using Time-Warping in a Vocoder

Human voices consist of two components. One component comprises fundamental waves that are pitch-sensitive and the other is fixed harmonics which are not pitch sensitive. The perceived pitch of a sound is the ear's response to frequency, i.e., for most practical purposes the pitch is the frequency. The harmonics components add distinctive characteristics to a person's voice. They change along with the vocal cords and with the physical shape of the vocal tract and are called formants.

Human voice can be represented by a digital signal s(n) 10. Assume s(n) 10 is a digital speech signal obtained during a typical conversation including different vocal sounds and periods of silence. The speech signal s(n) 10 is preferably portioned into frames 20. In one embodiment, s(n) 10 is digitally sampled at 8 kHz.

Current coding schemes compress a digitized speech signal 10 into a low bit rate signal by removing all of the natural redundancies (i.e., correlated elements) inherent in speech. Speech typically exhibits short term redundancies resulting from the mechanical action of the lips and tongue, and long term redundancies resulting from the vibration of the vocal cords. Linear Predictive Coding (LPC) filters the speech signal 10 by removing the redundancies producing a residual speech signal 30. It then models the resulting residual signal 30 as white Gaussian noise. A sampled value of a speech waveform may be predicted by weighting a sum of a number of past samples 40, each of which is multiplied by a linear predictive coefficient 50. Linear predictive coders, therefore, achieve a reduced bit rate by transmitting filter coefficients 50 and quantized noise rather than a full bandwidth speech signal 10. The residual signal 30 is encoded by extracting a prototype period 100 from a current frame 20 of the residual signal 30.

A block diagram of one embodiment of a LPC vocoder 70 used by the present method and apparatus can be seen in FIG. 1. The function of LPC is to minimize the sum of the squared differences between the original speech signal and the estimated speech signal over a finite duration. This may produce a unique set of predictor coefficients 50 which are normally estimated every frame 20. A frame 20 is typically 20 ms long. The transfer function of the time-varying digital filter 75 is given by:

$$H(z) = \frac{G}{1 - \sum a_k z^{-k}},$$

where the predictor coefficients 50 are represented by $a_k$ and the gain by G.

The summation is computed from k=1 to k=p. If an LPC-10 method is used, then p=10. This means that only the first 10 coefficients 50 are transmitted to the LPC synthesizer 80. The two most commonly used methods to compute the coefficients are, but not limited to, the covariance method and the auto-correlation method.

It is common for different speakers to speak at different speeds. Time compression is one method of reducing the effect of speed variation for individual speakers. Timing differences between two speech patterns may be reduced by warping the time axis of one so that the maximum coincidence is attained with the other. This time compression technique is known as time-warping. Furthermore, time-warping compresses or expands voice signals without changing their pitch.

Typical vocoders produce frames 20 of 20 msec duration, including 160 samples 90 at the preferred 8 kHz rate. A time-warped compressed version of this frame 20 has a duration smaller than 20 msec, while a time-warped expanded version has a duration larger than 20 msec. Time-warping of voice data has significant advantages when sending voice data over packet-switched networks, which introduce delay jitter in the transmission of voice packets. In such networks, time-warping can be used to mitigate the effects of such delay jitter and produce a "synchronous" looking voice stream.

Embodiments of the invention relate to an apparatus and method for time-warping frames 20 inside the vocoder 70 by manipulating the speech residual 30. In one embodiment, the present method and apparatus is used in 4 GV. The disclosed embodiments comprise methods and apparatuses or systems to expand/compress different types of 4 GV speech segments 110 encoded using Prototype Pitch Period (PPP), Code-Excited Linear Prediction (CELP) or (Noise-Excited Linear Prediction (NELP) coding.

The term "vocoder" 70 typically refers to devices that compress voiced speech by extracting parameters based on a model of human speech generation. Vocoders 70 include an encoder 204 and a decoder 206. The encoder 204 analyzes the incoming speech and extracts the relevant parameters. In one embodiment, the encoder comprises a filter 75. The decoder 206 synthesizes the speech using the parameters that it receives from the encoder 204 via a transmission channel 208. In one embodiment, the decoder comprises a synthesizer 80. The speech signal 10 is often divided into frames 20 of data and block processed by the vocoder 70.

Figure 2A:
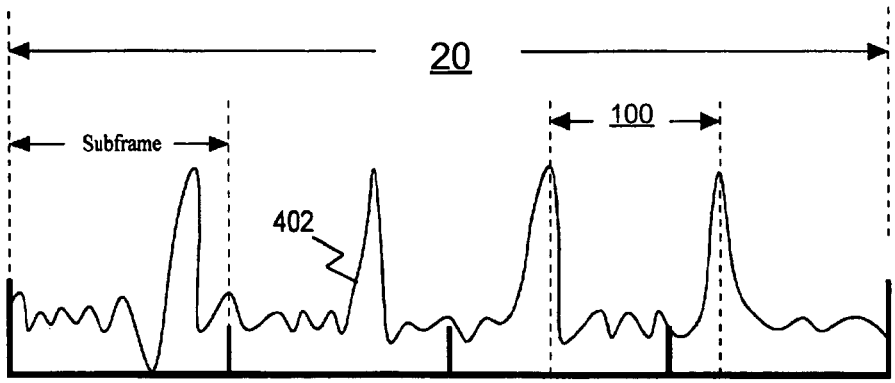
FIG. 2A is a speech signal containing voiced speech.

Those skilled in the art will recognize that human speech can be classified in many different ways. Three conventional classifications of speech are voiced, unvoiced sounds and transient speech. FIG. 2A is a voiced speech signal s(n) 402. FIG. 2A shows a measurable, common property of voiced speech known as the pitch period 100.

Figure 2B:
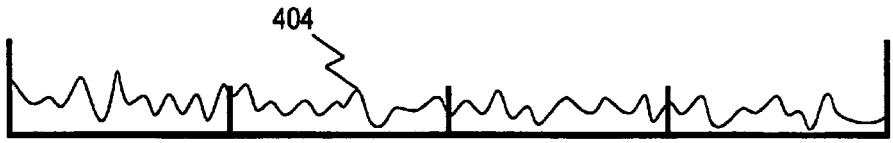
FIG. 2B is a speech signal containing unvoiced speech.

FIG. 2B is an unvoiced speech signal s(n) 404. An unvoiced speech signal 404 resembles colored noise.

Figure 2C:
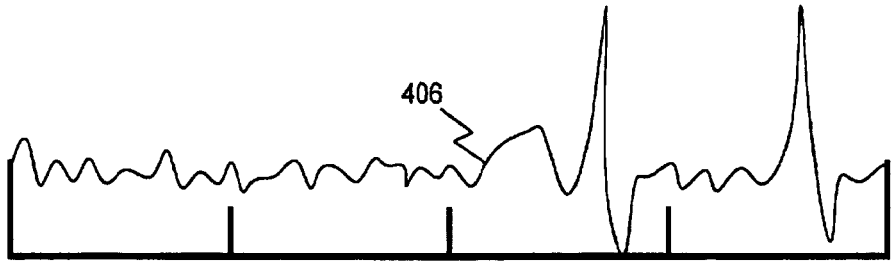
FIG. 2C is a speech signal containing transient speech.

FIG. 2C depicts a transient speech signal s(n) 406 (i.e., speech which is neither voiced nor unvoiced). The example of transient speech 406 shown in FIG. 2C might represent s(n) transitioning between unvoiced speech and voiced speech. These three classifications are not all inclusive. There are many different classifications of speech which may be employed according to the methods described herein to achieve comparable results.

The 4GV Vocoder Uses 4 Different Frame Types

The fourth generation vocoder (4GV) 70 used in one embodiment of the invention provides attractive features for use over wireless networks. Some of these features include the ability to trade-off quality vs. bit rate, more resilient vocoding in the face of increased packet error rate (PER), better concealment of erasures, etc. The 4GV vocoder 70 can use any of four different encoders 204 and decoders 206. The different encoders 204 and decoders 206 operate according to different coding schemes. Some encoders 204 are more effective at coding portions of the speech signal s(n) 10 exhibiting certain properties. Therefore, in one embodiment, the encoders 204 and decoders 206 mode may be selected based on the classification of the current frame 20.

The 4GV encoder 204 encodes each frame 20 of voice data into one of four different frame 20 types: Prototype Pitch Period Waveform Interpolation (PPPWI), Code-Excited Linear Prediction (CELP), Noise-Excited Linear Prediction (NELP), or silence $1/8^{th}$ rate frame. CELP is used to encode speech with poor periodicity or speech that involves changing from one periodic segment 110 to another. Thus, the CELP mode is typically chosen to code frames classified as transient speech. Since such segments 110 cannot be accurately reconstructed from only one prototype pitch period, CELP encodes characteristics of the complete speech segment 110. The CELP mode excites a linear predictive vocal tract model with a quantized version of the linear prediction residual signal 30. Of all the encoders 204 and decoders 206 described herein, CELP generally produces more accurate speech reproduction, but requires a higher bit rate.

A Prototype Pitch Period (PPP) mode can be chosen to code frames 20 classified as voiced speech. Voiced speech contains slowly time varying periodic components which are exploited by the PPP mode. The PPP mode codes a subset of the pitch periods 100 within each frame 20. The remaining periods 100 of the speech signal 10 are reconstructed by interpolating between these prototype periods 100. By exploiting the periodicity of voiced speech, PPP is able to achieve a lower bit rate than CELP and still reproduce the speech signal 10 in a perceptually accurate manner.

PPPWI is used to encode speech data that is periodic in nature. Such speech is characterized by different pitch periods 100 being similar to a "prototype" pitch period (PPP). This PPP is the only voice information that the encoder 204 needs to encode. The decoder can use this PPP to reconstruct other pitch periods 100 in the speech segment 110.

A "Noise-Excited Linear Predictive" (NELP) encoder 204 is chosen to code frames 20 classified as unvoiced speech. NELP coding operates effectively, in terms of signal reproduction, where the speech signal 10 has little or no pitch structure. More specifically, NELP is used to encode speech that is noise-like in character, such as unvoiced speech or background noise. NELP uses a filtered pseudo-random noise signal to model unvoiced speech. The noise-like character of such speech segments 110 can be reconstructed by generating random signals at the decoder 206 and applying appropriate gains to them. NELP uses the simplest model for the coded speech, and therefore achieves a lower bit rate.

$1/8^{th}$ rate frames are used to encode silence, e.g., periods where the user is not talking.

Figure 3:
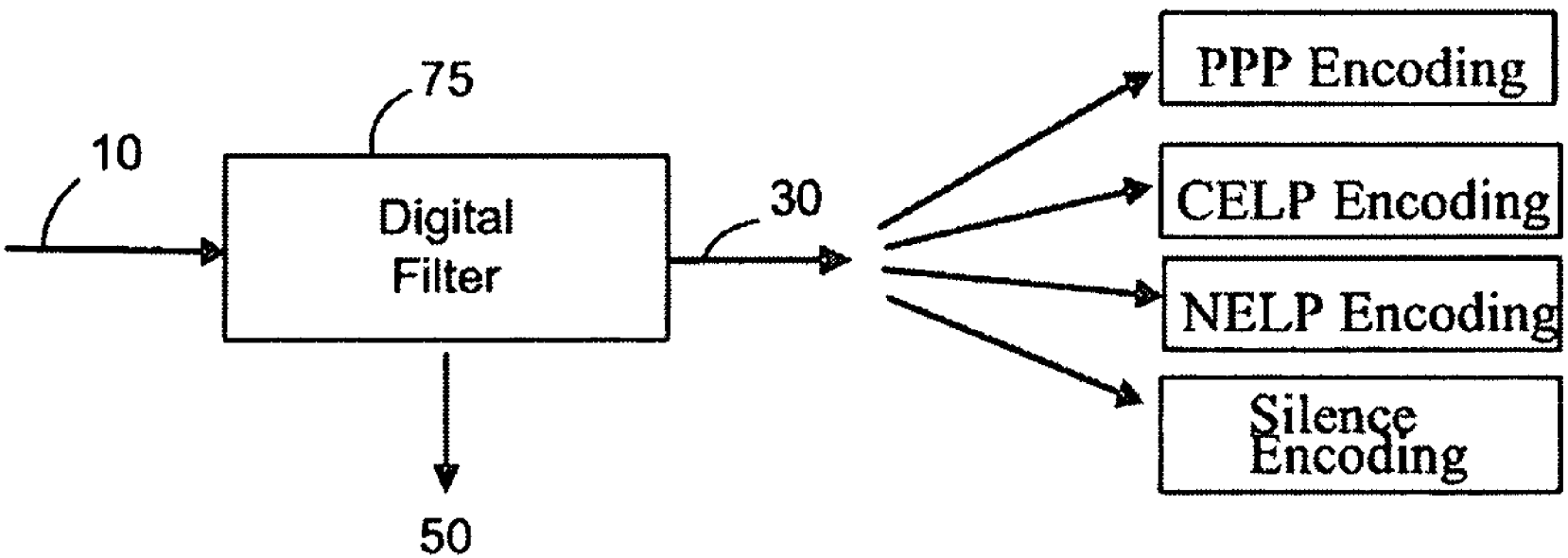
FIG. 3 is a block diagram illustrating LPC Filtering of Speech followed by Encoding of a Residual.

All of the four vocoding schemes described above share the initial LPC filtering procedure as shown in FIG. 3. After characterizing the speech into one of the 4 categories, the speech signal 10 is sent through a linear predictive coding (LPC) filter 80 which filters out short-term correlations in the speech using linear prediction. The outputs of this block are the LPC coefficients 50 and the "residual" signal 30, which is basically the original speech signal 10 with the short-term correlations removed from it. The residual signal 30 is then encoded using the specific methods used by the vocoding method selected for the frame 20.

Figures 4A, 4B:
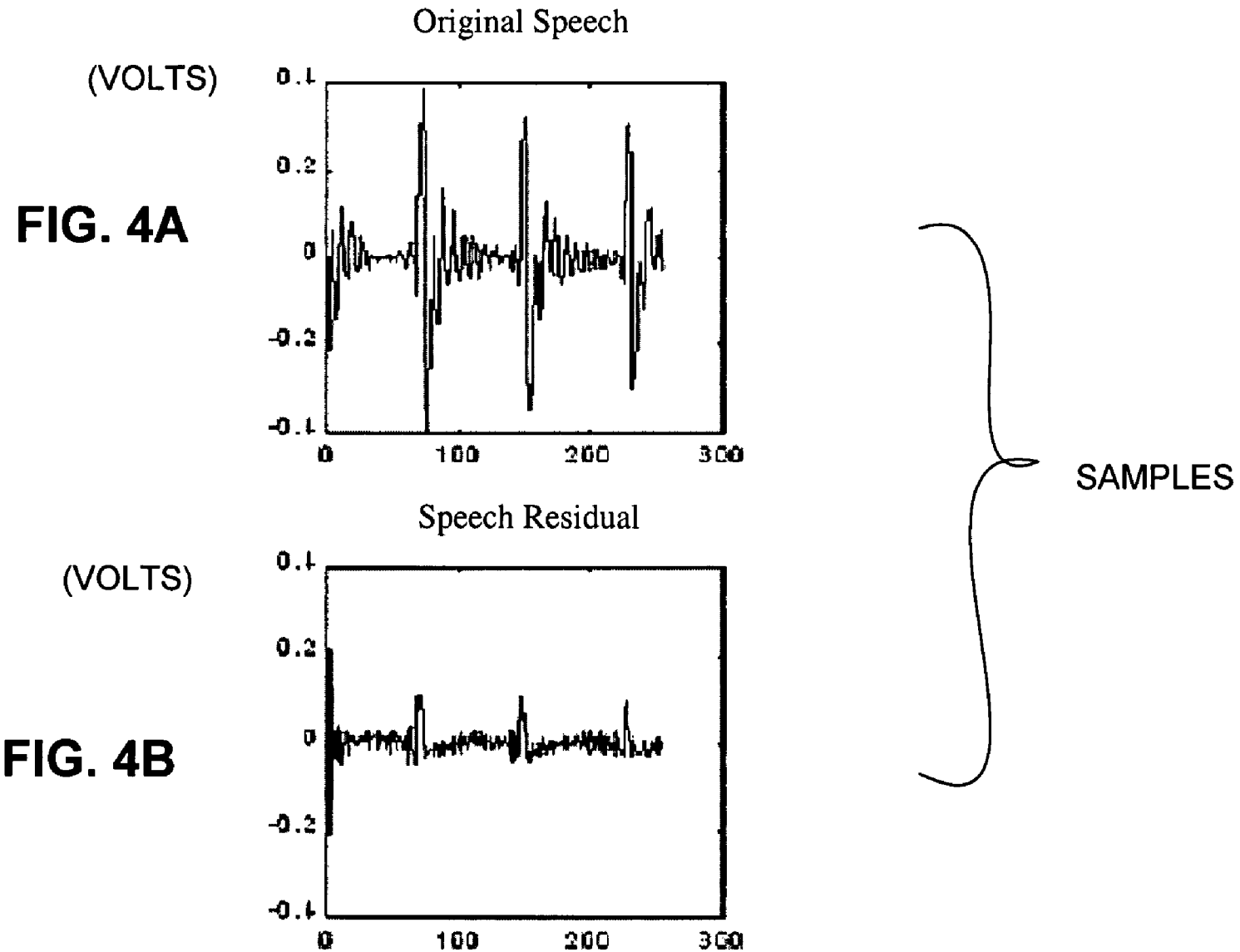
FIG. 4A is a plot of Original Speech.
FIG. 4B is a plot of a Residual Speech Signal after LPC Filtering.

FIGS. 4A-4B show an example of the original speech signal 10, and the residual signal 30 after the LPC block 80. It can be seen that the residual signal 30 shows pitch periods 100 more distinctly than the original speech 10. It stands to reason, thus, that the residual signal 30 can be used to determine the pitch period 100 of the speech signal more accurately than the original speech signal 10 (which also contains short-term correlations).

Residual Time Warping

As stated above, time-warping can be used for expansion or compression of the speech signal 10. While a number of methods may be used to achieve this, most of these are based on adding or deleting pitch periods 100 from the signal 10. The addition or subtraction of pitch periods 100 can be done in the decoder 206 after receiving the residual signal 30, but before the signal 30 is synthesized. For speech data that is encoded using either CELP or PPP (not NELP), the signal includes a number of pitch periods 100. Thus, the smallest unit that can be added or deleted from the speech signal 10 is a pitch period 100 since any unit smaller than this will lead to a phase discontinuity resulting in the introduction of a noticeable speech artifact. Thus, one step in time-warping methods applied to CELP or PPP speech is estimation of the pitch period 100. This pitch period 100 is already known to the decoder 206 for CELP/PPP speech frames 20. In the case of both PPP and CELP, pitch information is calculated by the encoder 204 using auto-correlation methods and is transmitted to the decoder 206. Thus, the decoder 206 has accurate knowledge of the pitch period 100. This makes it simpler to apply the time-warping method of the present invention in the decoder 206.

Furthermore, as stated above, it is simpler to time warp the signal 10 before synthesizing the signal 10. If such time-warping methods were to be applied after decoding the signal 10, the pitch period 100 of the signal 10 would need to be estimated. This requires not only additional computation, but also the estimation of the pitch period 100 may not be very accurate since the residual signal 30 also contains LPC information 170.

On the other hand, if the additional pitch period 100 estimation is not too complex, then doing time-warping after decoding does not require changes to the decoder 206 and can thus, be implemented just once for all vocoders 80.

Another reason for doing time-warping in the decoder 206 before synthesizing the signal using LPC coding synthesis is that the compression/expansion can be applied to the residual signal 30. This allows the linear predictive coding (LPC) synthesis to be applied to the time-warped residual signal 30. The LPC coefficients 50 play a role in how speech sounds and applying synthesis after warping ensures that correct LPC information 170 is maintained in the signal 10.

If, on the other hand, time-warping is done after the decoding the residual signal 30, the LPC synthesis has already been performed before time-warping. Thus, the warping procedure can change the LPC information 170 of the signal 10, especially if the pitch period 100 prediction post-decoding has not been very accurate. In one embodiment, the steps performed by the time-warping methods disclosed in the present application are stored as instructions located in software or firmware 81 located in memory 82. In FIG. 1, the memory is shown located inside the decoder 206. The memory 82 can also be located outside the decoder 206.

The encoder 204 (such as the one in 4GV) may categorize speech frames 20 as PPP (periodic), CELP (slightly periodic) or NELP (noisy) depending on whether the frames 20 represents voiced, unvoiced or transient speech. Using information about the speech frame 20 type, the decoder 206 can time-warp different frame 20 types using different methods. For instance, a NELP speech frame 20 has no notion of pitch periods and its residual signal 30 is generated at the decoder 206 using "random" information. Thus, the pitch period 100 estimation of CELP/PPP does not apply to NELP and, in general, NELP frames 20 may be warped (expanded/compressed) by less than a pitch period 100. Such information is not available if time-warping is performed after decoding the residual signal 30 in the decoder 206. In general, time-warping of NELP-like frames 20 after decoding leads to speech artifacts. Warping of NELP frames 20 in the decoder 206, on the other hand, produces much better quality.

Thus, there are two advantages to doing time-warping in the decoder 206 (i.e., before the synthesis of the residual signal 30) as opposed to post-decoder (i.e., after the residual signal 30 is synthesized): (i) reduction of computational overhead (e.g., a search for the pitch period 100 is avoided), and (ii) improved warping quality due to a) knowledge of the frame 20 type, b) performing LPC synthesis on the warped signal and c) more accurate estimation/knowledge of pitch period.

Residual Time Warping Methods

The following describe embodiments in which the present method and apparatus time-warps the speech residual 30 inside PPP, CELP and NELP decoders. The following two steps are performed in each decoder 206: (i) time-warping the residual signal 30 to an expanded or compressed version; and (ii) sending the time-warped residual 30 through an LPC filter 80. Furthermore, step (i) is performed differently for PPP, CELP and NELP speech segments 110. The embodiments will be described below.

Figure 5:
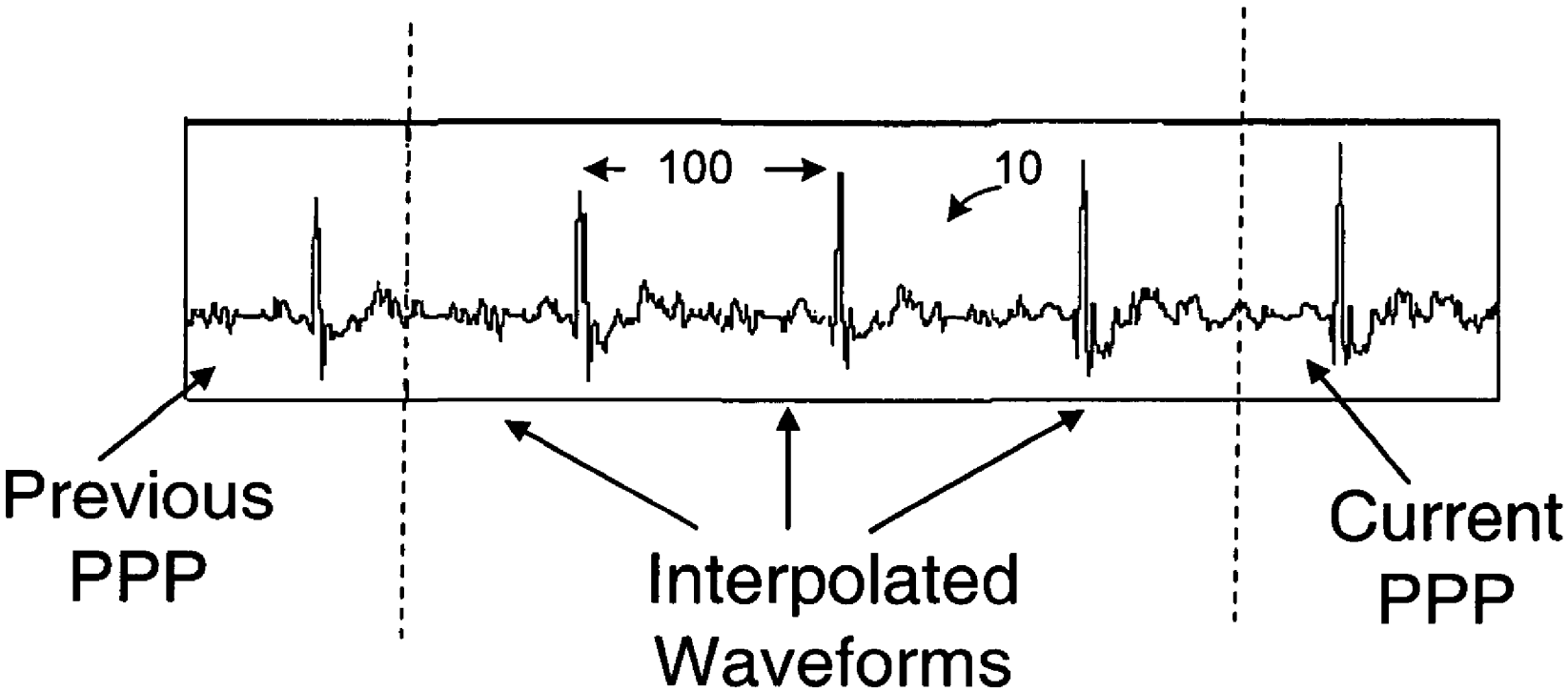
FIG. 5 illustrates the generation of Waveforms using Interpolation between Previous and Current Prototype Pitch Periods.

Time-Warping of Residual Signal when the Speech Segment 110 is PPP:

As stated above, when the speech segment 110 is PPP, the smallest unit that can be added or deleted from the signal is a pitch period 100. Before the signal 10 can be decoded (and the residual 30 reconstructed) from the prototype pitch period 100, the decoder 206 interpolates the signal 10 from the previous prototype pitch period 100 (which is stored) to the prototype pitch period 100 in the current frame 20, adding the missing pitch periods 100 in the process. This process is depicted in FIG. 5. Such interpolation lends itself rather easily to time-warping by producing less or more interpolated pitch periods 100. This will lead to compressed or expanded residual signals 30 which are then sent through the LPC synthesis.

Time-Warping of Residual Signal when Speech Segment 110 is CELP:

As stated earlier, when the speech segment 110 is PPP, the smallest unit that can be added or deleted from the signal is a pitch period 100. On the other hand, in the case of CELP, warping is not as straightforward as for PPP. In order to warp the residual 30, the decoder 206 uses pitch delay 180 information contained in the encoded frame 20. This pitch delay 180 is actually the pitch delay 180 at the end of the frame 20. It should be noted here that even in a periodic frame 20, the pitch delay 180 may be slightly changing. The pitch delays 180 at any point in the frame can be estimated by interpolating between the pitch delay 180 at the end of the last frame 20 and that at the end of the current frame 20. This is shown in FIG. 6. Once pitch delays 180 at all points in the frame 20 are known, the frame 20 can be divided into pitch periods 100. The boundaries of pitch periods 100 are determined using the pitch delays 180 at various points in the frame 20.

Figure 6A:
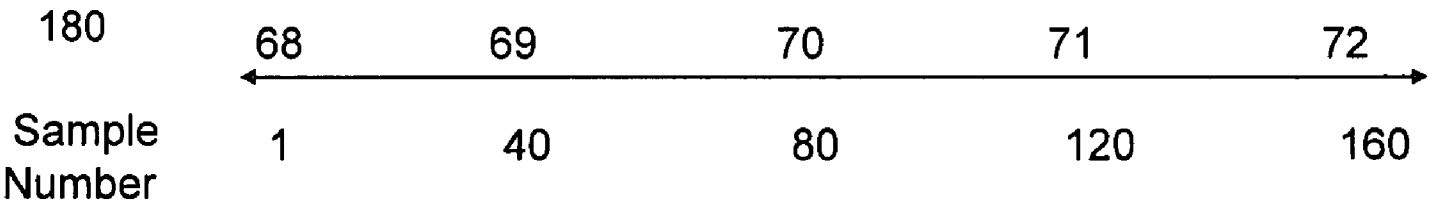
FIG. 6A depicts determining Pitch Delays through Interpolation.
Figure 6B:
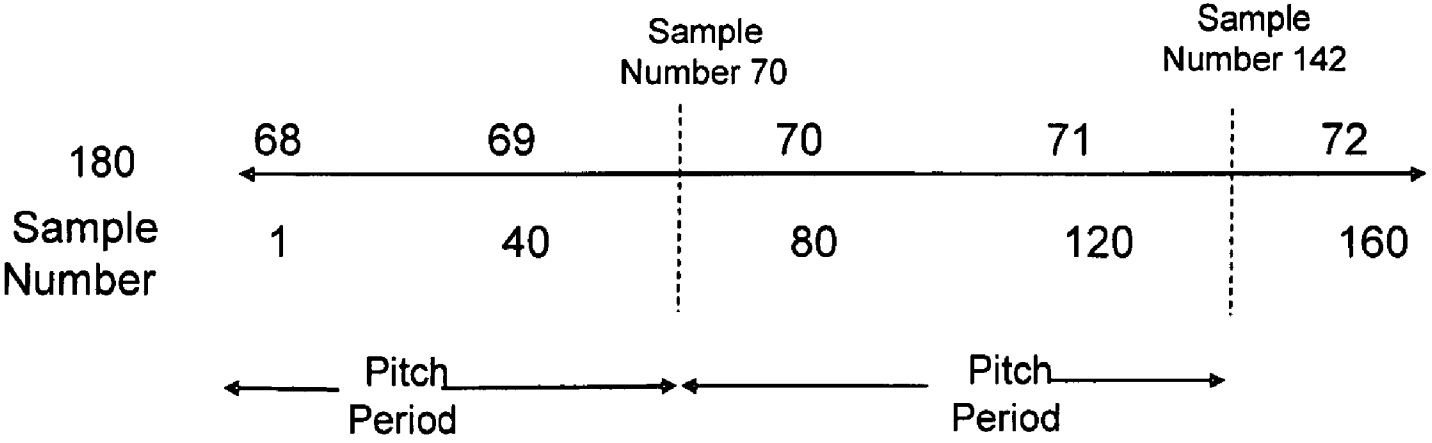
FIG. 6B depicts identifying pitch periods.

FIG. 6A shows an example of how to divide the frame 20 into its pitch periods 100. For instance, sample number 70 has a pitch delay 180 equal to approximately 70 and sample number 142 has a pitch delay 180 of approximately 72. Thus, the pitch periods 100 are from sample numbers [1-70] and from sample numbers [71-142]. See FIG. 6B.

Once the frame 20 has been divided into pitch periods 100, these pitch periods 100 can then be overlap-added to increase/decrease the size of the residual 30. See FIGS. 7B through 7F. In overlap and add synthesis, the modified signal is obtained by excising segments 110 from the input signal 10, repositioning them along the time axis and performing a weighted overlap addition to construct the synthesized signal 150. In one embodiment, the segment 110 can equal a pitch period 100. The overlap-add method replaces two different speech segments 110 with one speech segment 110 by "merging" the segments 110 of speech. Merging of speech is done in a manner preserving as much speech quality as possible. Preserving speech quality and minimizing introduction of artifacts into the speech is accomplished by carefully selecting the segments 110 to merge. (Artifacts are unwanted items like clicks, pops, etc.). The selection of the speech segments 110 is based on segment "similarity." The closer the "similarity" of the speech segments 110, the better the resulting speech quality and the lower the probability of introducing a speech artifact when two segments 110 of speech are overlapped to reduce/increase the size of the speech residual 30. A useful rule to determine if pitch periods should be overlap-added is if the pitch delays of the two are similar (as an example, if the pitch delays differ by less than 15 samples, which corresponds to about 1.8 msec).

Figure 7A:
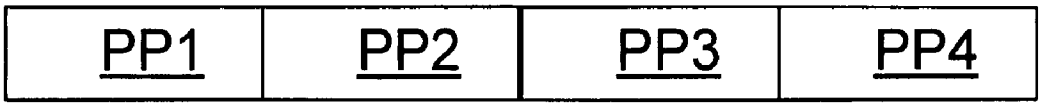
FIG. 7A represents an original speech signal in the form of pitch periods.
Figure 7B:
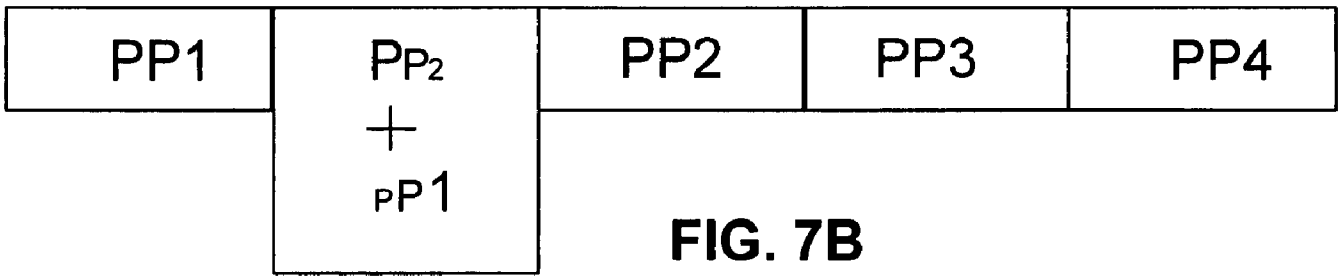
FIG. 7B represents a speech signal expanded using overlap-add.
Figure 7C:
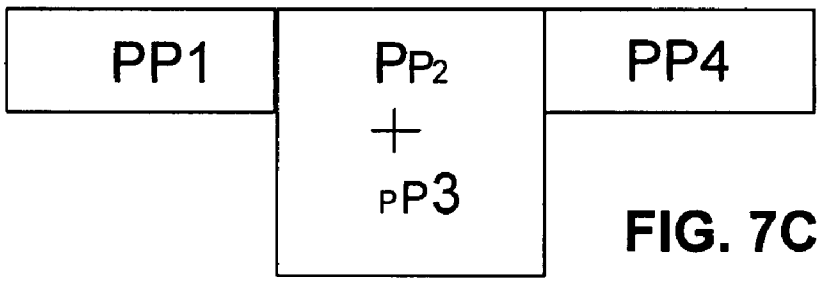
FIG. 7C represents a speech signal compressed using overlap-add.

FIG. 7C shows how overlap-add is used to compress the residual 30. The first step of the overlap/add method is to segment the input sample sequence s[n] 10 into its pitch periods as explained above. In FIG. 7A, the original speech signal 10 including 4 pitch periods 100 (PPs) is shown. The next step includes removing pitch periods 100 of the signal 10 shown in FIG. 7A and replacing these pitch periods 100 with a merged pitch period 100. For example in FIG. 7C, pitch periods PP2 and PP3 are removed and then replaced with one pitch period 100 in which PP2 and PP3 are overlap-added. More specifically, in FIG. 7C, pitch periods 100 PP2 and PP3 are overlap-added such that the second pitch period's 100 (PP2) contribution goes on decreasing and that of PP3 is increasing. The add-overlap method produces one speech segment 110 from two different speech segments 110. In one embodiment, the add-overlap is performed using weighted samples. This is illustrated in equations a) and b) as shown in FIG. 8. Weighting is used to provide a smooth transition between the first PCM (Pulse Coded Modulation) sample of Segment1 (110) and the last PCM sample of Segment2 (110).

Figure 7D:
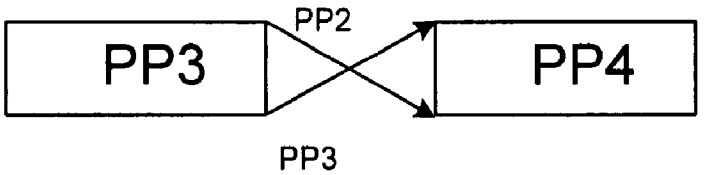
FIG. 7D represents how weighting is used to compress the residual signal.
Figure 7E:
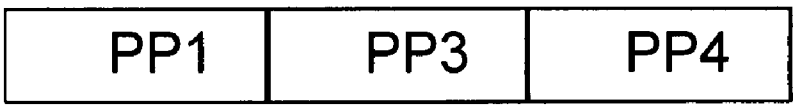
FIG. 7E represents a speech signal compressed without using overlap-add.

FIG. 7D is another graphic illustration of PP2 and PP3 being overlap-added. The cross fade improves the perceived quality of a signal 10 time compressed by this method when compared to simply removing one segment 110 and abutting the remaining adjacent segments 110 (as shown in FIG. 7E).

In cases when the pitch period 100 is changing, the overlap-add method may merge two pitch periods 110 of unequal length. In this case, better merging may be achieved by aligning the peaks of the two pitch periods 100 before overlap-adding them. The expanded/compressed residual is then sent through the LPC synthesis.

Speech Expansion

A simple approach to expanding speech is to do multiple repetitions of the same PCM samples. However, repeating the same PCM samples more than once can create areas with pitch flatness which is an artifact easily detected by humans (e.g., speech may sound a bit "robotic"). In order to preserve speech quality, the add-overlap method may be used.

Figure 7F:
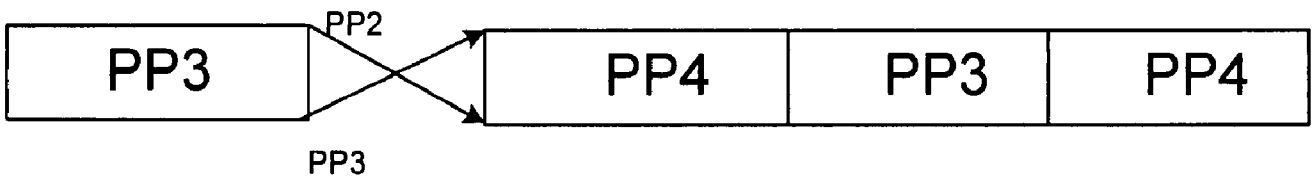
FIG. 7F represents how weighting is used to expand the residual signal.

FIG. 7B shows how this speech signal 10 can be expanded using the overlap-add method of the present invention. In FIG. 7B, an additional pitch period 100 created from pitch periods 100 PP1 and PP2 is added. In the additional pitch period 100, pitch periods 100 PP2 and PP1 are overlap-added such that the second pitch (PP2) period's 100 contribution goes on decreasing and that of PP1 is increasing. FIG. 7F is another graphic illustration of PP2 and PP3 being overlap added.

Time-Warping of the Residual Signal when the Speech Segment is NELP:

For NELP speech segments, the encoder encodes the LPC information as well as the gains for different parts of the speech segment 110. It is not necessary to encode any other information since the speech is very noise-like in nature. In one embodiment, the gains are encoded in sets of 16 PCM samples. Thus, for example, a frame of 160 samples may be represented by 10 encoded gain values, one for each 16 samples of speech. The decoder 206 generates the residual signal 30 by generating random values and then applying the respective gains on them. In this case, there may not be a concept of pitch period 100, and as such, the expansion/compression does not have to be of the granularity of a pitch period 100.

In order to expand or compress a NELP segment, the decoder 206 generates a larger or smaller number of segments (110) than 160, depending on whether the segment 110 is being expanded or compressed. The 10 decoded gains are then applied to the samples to generate an expanded or compressed residual 30. Since these 10 decoded gains correspond to the original 160 samples, these are not applied directly to the expanded/compressed samples. Various methods may be used to apply these gains. Some of these methods are described below.

If the number of samples to be generated is less than 160, then all 10 gains need not be applied. For instance, if the number of samples is 144, the first 9 gains may be applied. In this instance, the first gain is applied to the first 16 samples, samples 1-16, the second gain is applied to the next 16 samples, samples 17-32, etc. Similarly, if samples are more than 160, then the $10^{th}$ gain can be applied more than once. For instance, if the number of samples is 192, the $10^{th}$ gain can be applied to samples 145-160, 161-176, and 177-192.

Alternately, the samples can be divided into 10 sets of equal number, each set having an equal number of samples, and the 10 gains can be applied to the 10 sets. For instance, if the number of samples is 140, the 10 gains can be applied to sets of 14 samples each. In this instance, the first gain is applied to the first 14 samples, samples 1-14, the second gain is applied to the next 14 samples, samples 15-28, etc.

If the number of samples is not perfectly divisible by 10, then the $10^{th}$ gain can be applied to the remainder samples obtained after dividing by 10. For instance, if the number of samples is 145, the 10 gains can be applied to sets of 14 samples each. Additionally, the $10^{th}$ gain is applied to samples 141-145.

After time-warping, the expanded/compressed residual 30 is sent through the LPC synthesis when using any of the above recited encoding methods.

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The various illustrative logical blocks, modules, and circuits described in connection with the embodiments disclosed herein may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD-ROM, or any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal. The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A method communicating speech, comprising:

receiving a residual speech signal, wherein the residual speech signal is based on speech segments that were encoded using prototype pitch period (PPP), code-excited linear prediction (CELP), noise-excited linear prediction (NELP) or ⅛ frame coding;

time-warping a residual speech segment in the residual speech signal by adding or subtracting at least one sample to the residual speech segment, wherein one of a plurality of different time-warping methods is selected based on whether the speech segment was encoded using prototype pitch period, code-excited linear prediction, noise-excited linear prediction or ⅛ frame coding, wherein if the speech segment was encoded using CELP, the time warping method comprises:

estimating pitch delays in the residual speech signal;

dividing the residual speech signal into pitch periods, wherein boundaries of said pitch periods are determined using pitch delays at various points in the residual speech signal;

overlapping said pitch periods if said residual speech signal is decreased;

adding said pitch periods if said residual speech signal is increased; and generating a synthesized speech signal based on said time-warped residual speech signal.

2. The method of communicating speech according to claim 1, further comprising the steps of:

classifying speech frames;

encoding the frames, comprising:

sending said speech signal through a linear predictive coding filter, whereby short-term correlations in said speech signal are filtered out; and outputting linear predictive coding coefficients and the residual signal.

3. The method of communicating speech according to claim 2, wherein said step of classifying speech frames comprises categorizing speech frames as periodic, slightly periodic or noisy depending on whether the frames represents voiced, unvoiced or transient speech.

4. The method according to claim 1, wherein said step of time-warping comprises the steps of:

interpolating at least one pitch period; and wherein said adding or subtracting comprises:

adding said at least one pitch period when expanding said residual speech signal; and subtracting said at least one pitch period when compressing said residual speech signal.

5. The method according to claim 2, wherein if the encoding uses noise-excited linear prediction encoding, said step of encoding further comprises encoding linear predictive coding information as gains of different parts of a speech segment.

6. The method according to claim 1, wherein said step of overlapping said pitch periods if said speech residual signal is decreased comprises:

segmenting an input sample sequence into blocks of samples;

removing segments of said residual signal at regular time intervals;

merging said removed segments; and replacing said removed segments with a merged segment.

7. The method according to claim 1, wherein said step of estimating pitch delay comprises interpolating between a pitch delay of an end of a last frame and an end of a current frame.

8. The method according to claim 1, wherein said step of adding said pitch periods comprises merging speech segments.

9. The method according to claim 1, wherein said step of adding said pitch periods if said residual speech signal is increased comprises adding an additional pitch period created from a first pitch segment and a second pitch period segment.

10. The method according to claim 5, wherein said gains are encoded for sets of speech samples.

11. The method according to claim 6, wherein said step of merging said removed segments comprises increasing a first pitch period segment's contribution and decreasing a second pitch period segment's contribution.

12. The method according to claim 8, further comprising the step of selecting similar speech segments, wherein said similar speech segments are merged.

13. The method according to claim 8, further comprising the step of correlating speech segments, whereby similar speech segments are selected.

14. The method according to claim 9, wherein said step of adding an additional pitch period created from a first pitch segment and a second pitch period segment comprises adding said first and said second pitch segments such that said first pitch period segment's contribution increases and said second pitch period segment's contribution decreases.

15. The method according to claim 10, further comprising the step of generating a residual signal by generating random values and then applying said gains to said random values.

16. The method according to claim 10, further comprising the step of representing said linear predictive coding information as 10 encoded gain values, wherein each encoded gain value represents 16 samples of speech.

17. A vocoder having at least one input and at least one output, comprising:

a decoder that receives a residual speech signal, wherein the residual speech signal is based on speech segments that were encoded using prototype pitch period (PPP), code-excited linear prediction (CELP), noise-excited linear prediction (NELP) or ⅛ frame coding; and wherein the decoder comprises a synthesizer having at least one input operably connected to said at least one output of said encoder and at least one output operably connected to said at least one output of the vocoder, and a memory, wherein the decoder is adapted to execute software instructions stored in said memory comprising time-warping a residual speech segment in the residual speech signal by adding or subtracting at least one sample to the residual speech segment, wherein one of a plurality of different time-warping methods is selected based on whether the speech segment was encoded using prototype pitch period, code-excited linear prediction, noise-excited linear prediction or ⅛ frame coding, wherein if the speech segment was encoded using CELP, the time warping method comprises:

estimating pitch delays in the residual speech signal;

dividing the residual speech signal into pitch periods, wherein boundaries of said pitch periods are determined using pitch delays at various points in the residual speech signal;

overlapping said pitch periods if said residual speech signal is decreased; and adding said pitch periods if said residual speech signal is increased.

18. The vocoder according to claim 17, further comprising:

an encoder comprising a filter having at least one input operably connected to the input of the vocoder and at least one output, said filter is a linear predictive coding filter which is adapted to:

filter out short-term correlations in a speech signal; and output linear predictive coding coefficients and the residual signal.

19. The vocoder according to claim 18, wherein said encoder comprises:

a memory and said encoder is adapted to execute software instructions stored in said memory comprising encoding said speech segments using code-excited linear prediction encoding.

20. The vocoder according to claim 18, wherein said encoder comprises:

a memory and said encoder is adapted to execute software instructions stored in said memory comprising encoding said speech segments using noise-excited linear prediction encoding.

21. The vocoder according to claim 17, wherein said time-warping software instruction comprises:

interpolating at least one pitch period; and wherein said adding or subtracting comprises:

adding said at least one pitch period when expanding said residual speech signal; and subtracting said at least one pitch period when compressing said residual speech signal.

22. The vocoder according to claim 20, wherein said encoding said speech segments using noise-excited linear prediction encoding software instruction comprises encoding linear predictive coding information as gains of different parts of a speech segment.

23. The vocoder according to claim 17, wherein said overlapping said pitch periods if said speech residual signal is decreased instruction comprises:

segmenting an input sample sequence into blocks of samples;

removing segments of said residual signal at regular time intervals;

merging said removed segments; and replacing said removed segments with a merged segment.

24. The vocoder according to claim 17, wherein said estimating pitch delay instruction comprises interpolating between a pitch delay of an end of a last frame and an end of a current frame.

25. The vocoder according to claim 17, wherein said adding said pitch periods instruction comprises merging speech segments.

26. The vocoder according to claim 17, wherein said adding said pitch periods if said speech residual signal is increased instruction comprises adding an additional pitch period created from a first pitch segment and a second pitch period segment.

27. The vocoder according to claim 22, wherein said gains are encoded for sets of speech samples.

28. The vocoder according to claim 23, wherein said merging said removed segments instruction comprises increasing a first pitch period segment's contribution and decreasing a second pitch period segment's contribution.

29. The vocoder according to claim 25, further comprising the step of selecting similar speech segments, wherein said similar speech segments are merged.

30. The vocoder to claim 25, wherein said time-warping instruction further comprises correlating speech segments, whereby similar speech segments are selected.

31. The vocoder according to claim 26, wherein said adding an additional pitch period created from a first pitch segment and a second pitch period segment instruction comprises adding said first and said second pitch segments such that said first pitch period segment's contribution increases and said second pitch period segment's contribution decreases.

32. The vocoder according to claim 27, wherein said time-warping instruction further comprises generating a residual speech signal by generating random values and then applying said gains to said random values.

33. The vocoder according to claim 27, wherein said time-warping instruction further comprises representing said linear predictive coding information as 10 encoded gain values, wherein each encoded gain value represents 16 samples of speech.

34. A vocoder comprising:

means for receiving a residual speech signal, wherein the residual speech signal is based on speech segments that were encoded using prototype pitch period (PPP), code-excited linear prediction (CELP), noise-excited linear prediction (NELP) or ⅛ frame coding to produce a residual signal;

means for time-warping a residual speech segment in the residual speech signal by adding or subtracting at least one sample to the residual speech segment, wherein one of a plurality of different time-warping methods is selected based on whether the speech segment was encoded using prototype pitch period, code-excited linear prediction, noise-excited linear prediction or ⅛ frame coding, wherein if the speech segment was encoded using CELP, the time warping method comprises:

estimating pitch delays in the residual speech signal;

dividing the residual speech signal into pitch periods, wherein boundaries of said pitch periods are determined using pitch delays at various points in the residual speech signal;

overlapping said pitch periods if said residual speech signal is decreased;

adding said pitch periods if said residual speech signal is increased; and means for generating a synthesized speech signal based on said time-warped residual speech signal.

35. A processor readable medium for communicating speech, comprising instructions for:

receiving a residual speech signal, wherein the residual speech signal is based on speech segments that were encoded using prototype pitch period (PPP), code-excited linear prediction (CELP), noise-excited linear prediction (NELP) or ⅛ frame coding to produce a residual signal;

time-warping a residual speech segment in the residual speech signal by adding or subtracting at least one sample to the residual speech segment, wherein one of a plurality of different time-warping methods is selected based on whether the speech segment was encoded using prototype pitch period, code-excited linear prediction, noise-excited linear prediction or ⅛ frame coding, wherein if the speech segment was encoded using CELP, the time warping method comprises:

estimating pitch delays in the residual speech signal;

dividing the residual speech signal into pitch periods, wherein boundaries of said pitch periods are determined using pitch delays at various points in the residual speech signal;

overlapping said pitch periods if said residual speech signal is decreased;

adding said pitch periods if said residual speech signal is increased; and generating a synthesized speech signal based on said time-warped residual speech signal.

* * * * *